United States Patent [19]

Tippins

[11] 4,308,739

[45] Jan. 5, 1982

[54] METHOD FOR MODERNIZING A HOT STRIP MILL

[75] Inventor: George W. Tippins, Pittsburgh, Pa.

[73] Assignee: Tippins Machinery Company, Inc., Pittsburgh, Pa.

[21] Appl. No.: 115,611

[22] Filed: Jan. 28, 1980

[51] Int. Cl.[3] ..... B21B 1/02

[52] U.S. Cl. ..... 72/229; 72/234

[58] Field of Search ..... 72/234, 229, 226, 227, 72/231, 365, 366

[56] References Cited

U.S. PATENT DOCUMENTS 3,803,891 4/1974 Smith ..... 72/231

FOREIGN PATENT DOCUMENTS 54-5785 3/1979 Japan ..... 72/234

199822 11/1965 Sweden ..... 72/229

*Primary Examiner*—Milton S. Mehr

*Attorney, Agent, or Firm*—Webb, Burden, Robinson & Webb

[57] ABSTRACT

Standard hot strip mills include a roughing train and a finishing train having a plurality of finishing stands F-1, F-2, F-3 . . . F-X. F-2 is eliminated from the finishing train and F-1 is converted into a reversing mill. Coiling furnaces are installed on either side of F-1 with the downstream coiling furnace replacing F-2. The resultant reversing mill and coiling furnaces are arranged so that a transfer bar is first reduced as it passes through F-1 in a forward direction and coiled in the downstream coiling furnace, then further reduced as it is passed in a reverse direction through F-1 to the upstream coiling furnace, then further reduced as it is passed the third time through F-1, and then further reduced to the final gauge as it passes successively through F-3 and the remainder of the finishing stands in the finishing train.

4 Claims, 4 Drawing Figures

METHOD FOR MODERNIZING A HOT STRIP MILL

FIELD OF THE INVENTION

My invention relates to the modernizing of hot strip mills and, more particularly, to increasing the productivity of a continuous hot strip mill by the conversion of the finishing train to include a reversing mill and coiling furnaces on opposite sides thereof.

DESCRIPTION OF THE PRIOR ART

Hot rolled coils, or hot band coils as they are traditionally termed in the steel industry, are produced by heating a slab and rolling it through a series of in-line rolling stands. The rolling sequence takes place in two stages termed the roughing mill and the finishing mill. The roughing mill includes one or more rolling mill stands in which a slab of generally four to seven inches thick is reduced to a hot transfer bar of approximately seven-tenths of an inch thick. The transfer bar is conveyed on a driven roller table and enters a continuous finishing mill which includes a plurality of finishing mill stands which are speed synchronized so as to reduce the transfer bar to the desired thickness, at which time the rolled strip continues on a run out table to a coiler located at the end of the hot strip mill.

Hot strip mills which were built during the period from the early 1930's to the early 1960's have become totally outmoded because they cannot produce hot band coils of the quality and size demanded by today's market and at production costs competitive with the more modern hot strip mills.

While many of these older hot strip mills have been shut down or scrapped, a number of such mills still remain in operation in seriously limited markets. A new hot strip mill of modern design requires an investment in excess of $300,000,000.00 and because of this, no new strip mills have been installed anywhere in the world in the past decade. There is also an increasing demand for high strength low-alloy (HSLA) steels which, because of a higher resistance to deformation during rolling, and the requirement for coils having high specific weight as measured by pounds per inch of coil width, termed PIW, can only be successfully produced on the newest generation of hot strip mills.

Today's market requires that hot band coils be produced in sizes weighing 15 to 40 tons or more and that they possess a high PIW. The present day market routinely requires 600 to 1000 PIW with some lesser demand up to 1250 PIW. In addition, consistent and accurate strip thickness from end to end is a requisite along with closely controlled physical properties as developed by thermal mechanical means during the rolling, cooling and coiling process.

The hot strip mills constructed during 1930 to 1960 can only produce hot rolled coils of 250 to 500 PIW with a resultant coil weight in the range of eight to ten tons, depending on the strip width. The reason that these existing mills cannot roll higher PIW coils is because they lack the power and speed to roll a heavier and longer transfer bar to finish thickness during the time period that the bar is at rolling temperature.

Hot strip mills manufactured in the 1960's and 1970's overcame these difficulties by including an abundance of power on each finishing stand so as to accelerate the transfer bar through the finishing mill at higher speeds, thereby decreasing the feed in time. This also adds heat energy to the strip through the rolling friction. The high speed "zoom" of such mills maintains uniform strip temperature and, therefore, uniform gauge and physical properties from end to end of large coils. Such a mill, however, costs hundreds of millions of dollars and can only be justified by a large and consistent strip market in the range of 3,000,000 tons per year.

One presently known way of overcoming the drawbacks of these old mills is the installation of a coil box as generally taught in U.S. Pat. No. 3,803,891. The coil box was developed to handle increased coil size and to permit the rolling of coils having greater pounds per inch of width without having to lengthen existing mills. In a coil box which is installed upstream of the finishing train, a red hot bar of up to one inch thick is bent into a coil to reduce temperature loss by reducing the exposed surface area and is held in that shape until it is fed through the finishing stands of the mill. While the use of a coil box does achieve certain advantages, it also has disadvantages. While the bar is in the coil box it is not being reduced and there is no heat input or thermal head. Moreover, the number of passes available in the finishing train is still the same as the number of finishing stands. In addition, the reduction schedule of each stand must be compatible with the speed cone of the finishing train.

Some forms of hot reversing mills have been used in conjunction with finishing trains. For example, a hot reversing mill with multiple coiling furnaces is disclosed in British Pat. No. 668,862. However, this British patent teaches the use of a plurality of coiler furnaces for purposes of storing material and turning over the underside of the strip prior to final rolling as well as providing a lower cost substitute to the conventional hot strip mill.

SUMMARY OF THE INVENTION

My invention provides for the acceptance of a heavy transfer bar, on the order of two inches thick, by the first finishing stand of the finishing train. My invention also provides for a minimum of two extra passes than the final number of finishing stands or one more pass than the number of finishing stands in the original installation. In addition, my invention adds a dynamic unit rather than a passive unit, thereby providing for a wide range of scheduling philosophies geared to rolling specific products. In addition, the entry speed of the transfer bar into F-1 and the second pass are at speeds independent of the speed cone of the finishing train which therefore provides flexibility in pass scheduling. I am also able to obtain uniformity of heat from head to tail, thereby resulting in more uniform metallurgical properties and providing a strip which will be more responsive to automatic gauge control.

In addition, since the strip temperature is maintained at a high level from head to tail during the first three passes as well as subsequent passes, hard to roll materials such as stainless steels can be produced on existing hot strip mills modernized by my invention.

My invention provides for increasing the product quality and range of existing and obsolete hot strip mills to present day standards by providing the means whereby the strip temperature is maintained at a high level during the finishing operation. Since the resistance to deformation is lower at high temperatures, the need for high separating force mill stands with accelerating power, which are typical of modern hot strip mills, eliminated thereby presenting opportunities to utilize existing mills.

To accomplish these objectives, my invention provides for the elimination of F-2 from the finishing train, the substitution therefor of a coiling furnace having a coiler arranged to receive and coil the transfer bar passed through F-1 in a forward direction and the addition of a second coiling furnace upstream of F-1 to receive and coil the transfer bar passing from the first coiling furnace through F-1 in a reverse direction. F-1 itself is converted into a reversing mill. The product is treated in a totally dynamic unit in which the total number of passes exceeds the resultant number of finishing stands by at least two.

DESCRIPTION OF THE PREFERRED EMBODIMENTS

Figure 1:
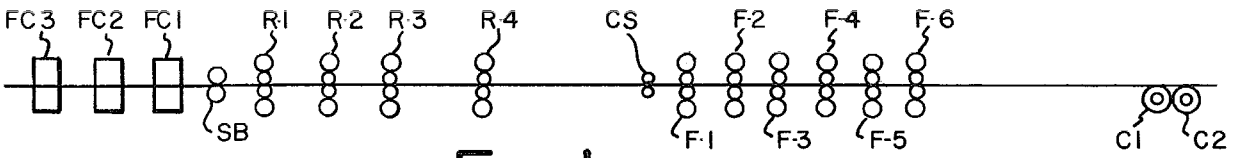
FIG. 1 is a schematic of an antiquated prior art continuous hot strip mill capable of producing coils of 150 to 275 PIW.

A typical continuous hot strip mill constructed prior to the 1960's and having a coil capability of 150 to 275 PIW is illustrated in FIG. 1. Furnaces FC1, FC2, and FC3 heat the slabs to the desired rolling temperatures and then alternately feed the slabs to a scale breaker, SB1, prior to entering the roughing train. The roughing train comprises four roughing stands R-1, R-2, R-3 and R-4. After leaving the roughing train the slab, now in the form of a transfer bar, proceeds down a motor driven roll table through a flying crop shear CS where the ends of the transfer bar are cropped. The slab, which normally starts out about six inches thick or greater, is reduced to about one inch thick or less in the roughing mill stands and enters the finishing train at this thickness. The finishing train consists of six finishing stands F-1, F-2, F-3, F-4, F-5 and F-6. This finishing train is run in synchronization by a speed cone which controls all six finishing stands. The rolled strip is coiled on one of two coilers, C1, C2. The particular mill illustrated has a length of approximately 811 feet from FC1 to C1. The distance from the final roughing stand R-4 to the first finishing stand F-1 is approximately 122 feet. The finishing stands are spaced 18 feet apart.

Figure 2:
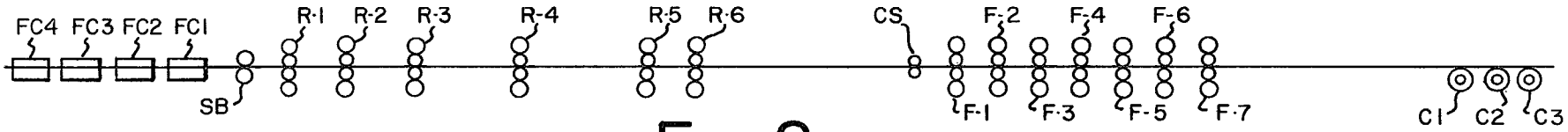
FIG. 2 is a schematic of a modern prior art continuous hot strip mill capable of producing coils to present day standards.

A modern continuous hot strip mill having a coil capability of 1000 PIW is illustrated in FIG. 2. Four furnaces, FC1, FC2, FC3 and FC4 heat the slabs to the desired rolling temperature and they alternately feed the slabs to the scale breaker SB1 prior to entering the roughing train. The roughing train includes six roughing stands R-1 through R-6 with the last two, i.e., R-5 and R-6 making continuous passes (slab is in both mills at same time). The slab which has now been reduced to about one inch thick or less in the roughing mill stands enters the finishing train.

The finishing train in this high powdered mill consists of seven synchronized finishing stands, F-1 through F-7. The rolled strip is coiled on one of three coilers C1, C2 and C3. The finishing mill stands have sufficient power to "zoom" the transfer bar through the finishing mill at a speed (with rolling frictional power heating the bar) so as to maintain a strip temperature and, therefore, gauge and physical properties from end to end.

However, the particular mill length from FC1 to C3 of the mill of FIG. 2 is in excess of 1700 feet and other mills of this type exceed 1900 feet.

Figure 3:
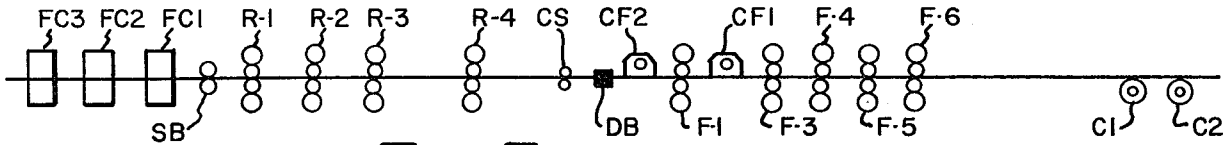
FIG. 3 is a schematic of the hot strip mill of FIG. 1 modernized in accordance with the subject invention and capable of producing coils to present day standards.
Figure 4:
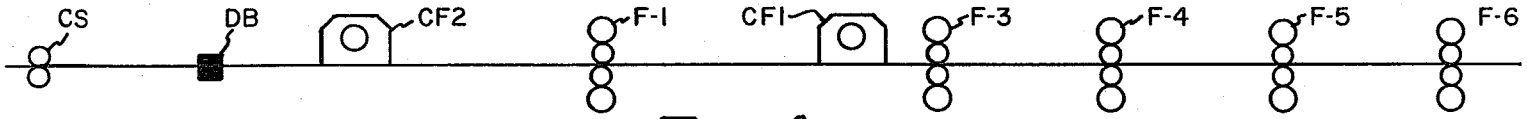
FIG. 4 is a schematic of the expanded arrangement of the finishing train of the hot strip mill of FIG. 2.

In accordance with my invention it is possible to convert the mill of FIG. 1 to a mill having the same capability as the mill of FIG. 2. In order to increase the productivity of the hot strip mill of FIG. 1 so that it can produce coils of 800–1000 PIW, the second finishing stand F-2 is removed, FIGS. 3 and 4. In its place is installed a downstream coiling furnace CF1. The coiling furnace CF1 includes a standard coiler having a mandrel. In addition, the coiling furnace includes heaters such as gas burners so that a positive heat head is formed within the coiling furnace, CF1, whereby cooling is prevented and some heat is added to the coiled material.

A second coiling furnace CF2 is installed upstream of the first finishing stand F-1. In order to make room for the coiling furnace CF2, the crop shear CS is further upstream from its location shown in FIG. 1 (see FIG. 3). A descaling box, DB, is shown after the crop shear CS and is optional. The coiling furnace CF2 is similar to CF1 in that it includes a coiler having a mandrel and a heat head formed by burners.

Stand F-1 is then converted into a reversing mill. To accomplish this conversion, the existing motor on F-1 will normally have to be replaced with one having greater power and higher speed. However, the speed cone for the hot mill finishing train need not be altered since the reversing mill F-1 becomes independent of the balance of the finishing train until the third pass as discussed hereinafter.

Rolling of the strip on the improved mill remains the same through the roughing train except that larger slabs can be employed which in turn result in transfer bars of greater thickness than heretofore employed. It will be recognized that the roughing train can be run continously with direct current motors or a reversing roughing mill may be employed. For example, a transfer bar in the range of two inches or more exits R-4 whereas heretofore a slab on the order of one inch thick formed the transfer bar. The two inch thick transfer bar is presented to F-1 and is reduced at a higher speed to approximately one inch in thickness and is then wound on the mandrel in coiling furnace CF1. Since the one inch thick bar is coiled, its exposed surface area is reduced and its heat loss is likewise reduced. In addition, the coiling furnace CF1 has a positive temperature head which precludes loss of heat and forces some heat into the bar. The transfer bar is thereafter passed at a higher speed through stand F-1 in the reverse direction where it is further reduced prior to being coiled on the mandrel in coiling furnace CF2.

The third pass in F-1 is in the forward direction and the bar then enters F-3, F-4, F-5 and F-6. Although one stand has been removed, the bar is rolled in seven passes to finish gauge. The entering speed in F-1 is entirely independent of the finishing train speed cone of stands F-3, F-4, F-5 and F-6 so the transfer bar with the increased PIW can be entered into F-1 at a "suck-in" speed in the range of 300–800 fpm or more. This entry speed is several times the entry speed of a conventional hot strip mill so that the transfer bar is exposed for only a short time. Therefore, the net result is that a much heavier transfer bar can be entered into the finishing train at a higher and more uniform temperature and the heat loss during rolling on F-1 will be reduced.

As the bar is rolled out of CF2 through F-1 for the third pass, its speed is matched to the speed cone of the remaining finishing stands. The bar is still in the furnace CF2 during the feed into F-3 with the result that it is much hotter at a thinner thickness than ever before.

Since the steel is uniformly hotter from head to tail, the resistance to deformation is less, the separating force is less and accordingly the strip gauge is more accurate. The product range and hot band coil size have been substantially increased for a continuous or a semi-continuous hot strip mill.

The fact that the steel will be uniformly rolled hotter is most significant when rolling stainless steels because of their high resistance to deformation. In rolling such steels, two additional passes can be carried out in F-1 so that a total of nine passes is achieved on a finishing train having only five mill stands. In addition, the mill when converted will be able to roll stainless steels to substantially thinner gauges than herebefore possible and thereby reduce the extent of the subsequent cold rolling and annealing operations normally required to produce finished stainless sheet.

Finally, my invention changes the functional relationship of the finishing stands and in so doing provides a marked improvement to the art of hot strip rolling as it has been practiced for the past 50 years. By means of the invention described hereinabove, the first two passes through the finishing mill are divorced from the limitation imposed by the maximum threading speed. In doing so many advantages in energy conservation, product quality, and control simplicity result.

I claim:

1. A method of increasing the productivity of a continuous or semi-continuous hot strip mill including a roughing train for converting a slab to a transfer bar on the order of two inches and a finishing train having a plurality of finishing stands, F-1, F-2, F-3 . . . F-X for converting the transfer bar to a hot rolled strip having a PIW in excess of 600 comprising:

A. eliminating F-2 from the finishing train;

B. converting F-1 to a reversing mill;

C. installing in lieu of F-2 a first coiling furnace having a mandrel coiler therein arranged to receive and coil the transfer bar on a first pass through F-1 in a forward direction; and D. installing a second coiling furnace having a mandrel coiler therein upstream of F-1 and which is likewise arranged to receive and coil the transfer bar passing from the first coiling furnace through F-1 in a reverse direction in a second pass.

2. A method of increasing the productivity of a continuous or semi-continuous hot strip mill including a roughing train for converting a slab to a transfer bar and a finishing train having a plurality of finishing stands F-1, F-2, F-3 . . . F-X for converting the transfer bar to a hot rolled strip comprising:

A. eliminating F-2 from the finishing train;

B. converting F-1 to a reversing mill;

C. installing in lieu of F-2 a first coiling furnace having a mandrel coiler therein arranged to receive and coil the transfer bar on a first pass through F-1 in a forward direction;

D. installing a second coiling furnace having a mandrel coiler therein upstream of F-1 and which is likewise arranged to receive and coil the transfer bar passing from the first coiling furnace through F-1 in a reverse direction in a second pass; and E. operating F-1 so that the first and second pass is independent of the constraints of the speed cone for the finishing passes.

3. The method of claim 2 wherein said first pass is on the order of 300 to 800 fpm.

4. The method of claim 2 including operating F-1 so the third pass through F-1 is within the constraints of the speed cone.

* * * * *